US006336272B1

(12) United States Patent
Lee

(10) Patent No.: US 6,336,272 B1
(45) Date of Patent: Jan. 8, 2002

(54) SCISSORS STRUCTURE

(76) Inventor: Ching Lu Lee, No. 13, Lane 319, Sec 2, Tai Ho Road, Chang Hua City (TW)

( * ) Notice: Subject to any disclaimer, the term of this patent is extended or adjusted under 35 U.S.C. 154(b) by 0 days.

(21) Appl. No.: 09/644,839

(22) Filed: Aug. 24, 2000

(51) Int. Cl.[7] ..... B26B 13/16
(52) U.S. Cl. ..... 30/262; 30/261
(58) Field of Search ..... 30/262, 261, 254, 30/234; 81/417, 427

(56) References Cited

U.S. PATENT DOCUMENTS 5,297,343 A * 3/1994 Melter et al. ..... 30/262
5,987,755 A * 11/1999 Shih ..... 30/262

* cited by examiner

*Primary Examiner*—Douglas D. Watts

(74) *Attorney, Agent, or Firm*—Bacon & Thomas, PLLC

(57) ABSTRACT

A scissors structure includes a first blade portion, a second blade portion, a restoring spring, and a substantially I-shaped locking member. The first blade portion includes a first handle defining a first chamber having a front end provided with a first locking stub and a rear end provided with a T-shaped first guide rail having a first guide track. The second blade portion includes a second handle defining a second chamber having a front end provided with a second locking stub and a rear end provided with a T-shaped second guide rail having a second guide track provided with a snapping boss. The restoring spring has a first end secured to the first locking stub and a second secured to the second locking stub. The locking member is slidably mounted between the first guide rail and the second guide rail and has two sides each provided with a T-shaped guide slot for receiving the first guide track and the second guide track. The guide slot has two sides each provided with a retaining flange for limiting the first guide track and the second guide track. The retaining flange defines a positioning notch for locking the snapping boss.

3 Claims, 6 Drawing Sheets

SCISSORS STRUCTURE

BACKGROUND OF THE INVENTION

1. Field of the Invention

The present invention relates to a scissors structure.

2. Description of the Related Art

A conventional scissors structure 50 in accordance with the prior art shown in FIG. 8 comprises two pivotally connected blades 51, two handles 54, a locking pin 52 secured on one of the two blades 51, a recessed locking piece 53 pivotally mounted on the other blade 51 and detachably locked on the locking pin 52, and a spring 55 mounted between the two handles 54.

However, connection between the locking piece 53 and the locking pin 52 is not stable so that the locking piece 53 is easily detached from the locking pin 52 so that the two handles 54 of the scissors structure are easily expanded even when not in use, thereby affecting the locking effect of the scissors structure. In addition, the scissors structure is in use, the locking piece 53 is suspended on the blade 51 as shown in phantom lines so that the locking piece 53 is easily in contact with the handles 54, thereby greatly influencing the operation of the handles 54 and the cutting action of the blades 51.

The closest prior art of which the applicant is aware is disclosed in U.S. Pat. No. 5,297,343 to Melter et al., filed on Jan. 7, 1993, entitled by "Trimming scissors and sheath assembly".

When the scissors are in use, the two handles 24 and 28 are separated from each other and the lock button 20 is attached to the handle 24. However, the lock button 20 freely slidable on the rails 68 and 70 is easily moved forward, thereby easily hindering the relative movement between the two handles 24 and 28 while the lock button 20 is easily broken when the two handles 24 and 28 are moved toward each other, thereby decreasing the lifetime of the scissors 10. In addition, the compression spring 18 mounted on the rear end of the lock button 20 is located away from the pivot point of the two handles 24 and 28, thereby easily clipping or injuring the user's hand. Further, the compression spring 18 is mounted on the rear end of the lock button 20 and is located away from the pivot point of the two handles 24 and 28 so that the tension of the two handles 24 and 28 of the scissors 10 is not efficient.

SUMMARY OF THE INVENTION

In accordance with one aspect of the present invention, there is provided a scissors structure comprising:

a first blade portion including a first handle defining a first chamber having a front end provided with a first locking stub and a rear end provided with a T-shaped first guide rail, the first guide rail having a front end provided with a first guide track located adjacent to the first locking stub and a rear end defining an access opening;

a second blade portion pivotally mounted on the first blade portion and including a second handle defining a second chamber having a front end provided with a second locking stub and a rear end provided with a T-shaped second guide rail provided with a second guide track, at least one snapping boss mounted on the second guide rail and aligning with the access opening of the first guide rail;

a restoring spring mounted between the first handle and the second handle and having a first end secured to the first locking stub and a second secured to the second locking stub; and a substantially I-shaped locking member slidably mounted between the first guide rail and the second guide rail and having two sides each provided with a T-shaped guide slot for receiving the first guide track of the first guide rail and the second guide track of the second guide rail, the guide slot having two sides each provided with an inward folded retaining flange for limiting the first guide track of the first guide rail and the second guide track of the second guide rail, the retaining flange defining at least one positioning notch for detachably locking the at least one snapping boss.

Further benefits and advantages of the present invention will become apparent after a careful reading of the detailed description with appropriate reference to the accompanying drawings.

DETAILED DESCRIPTION OF THE INVENTION

Figure 1:
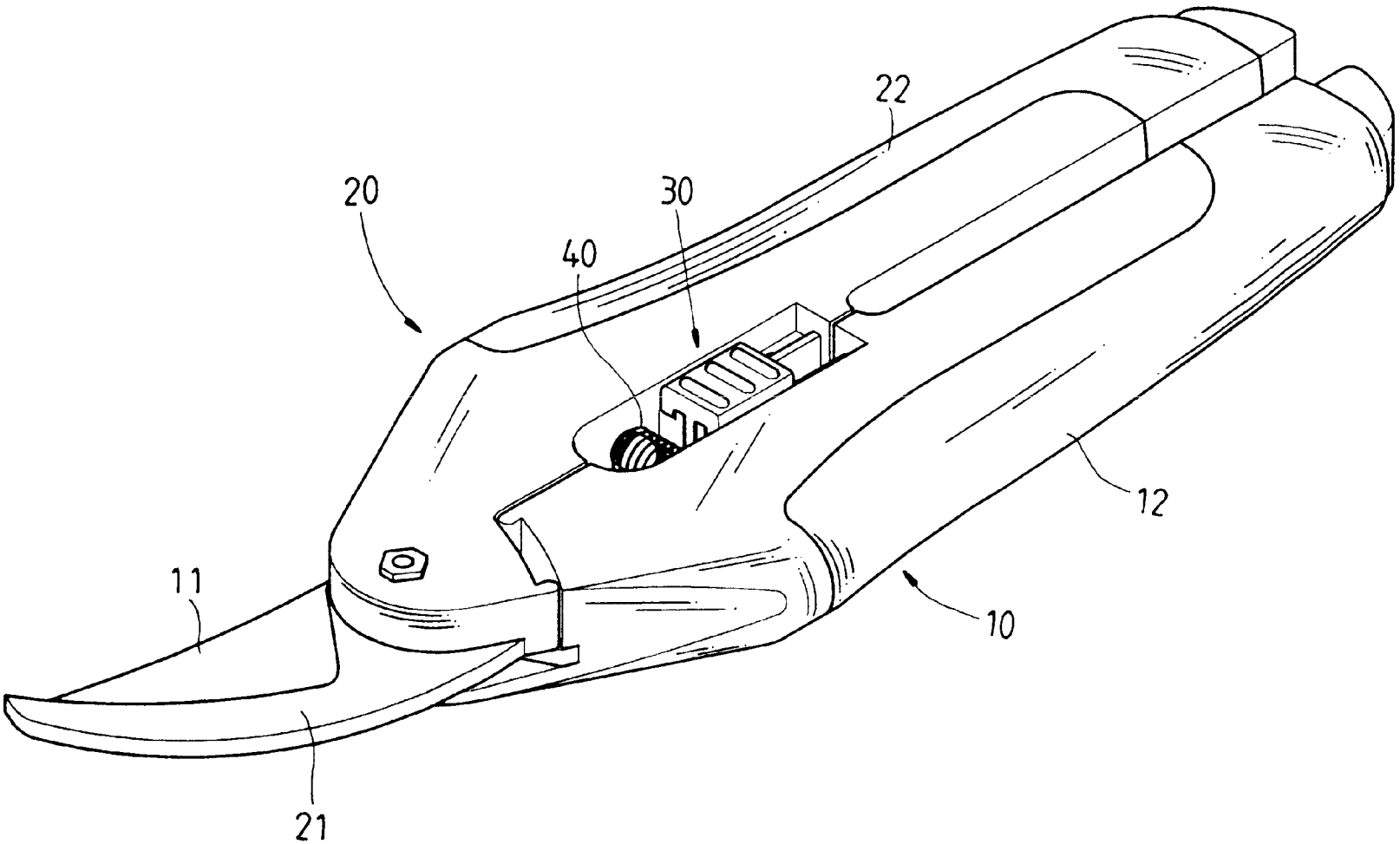
FIG. 1 is a perspective view of a scissors structure in accordance with the present invention.
Figure 2:
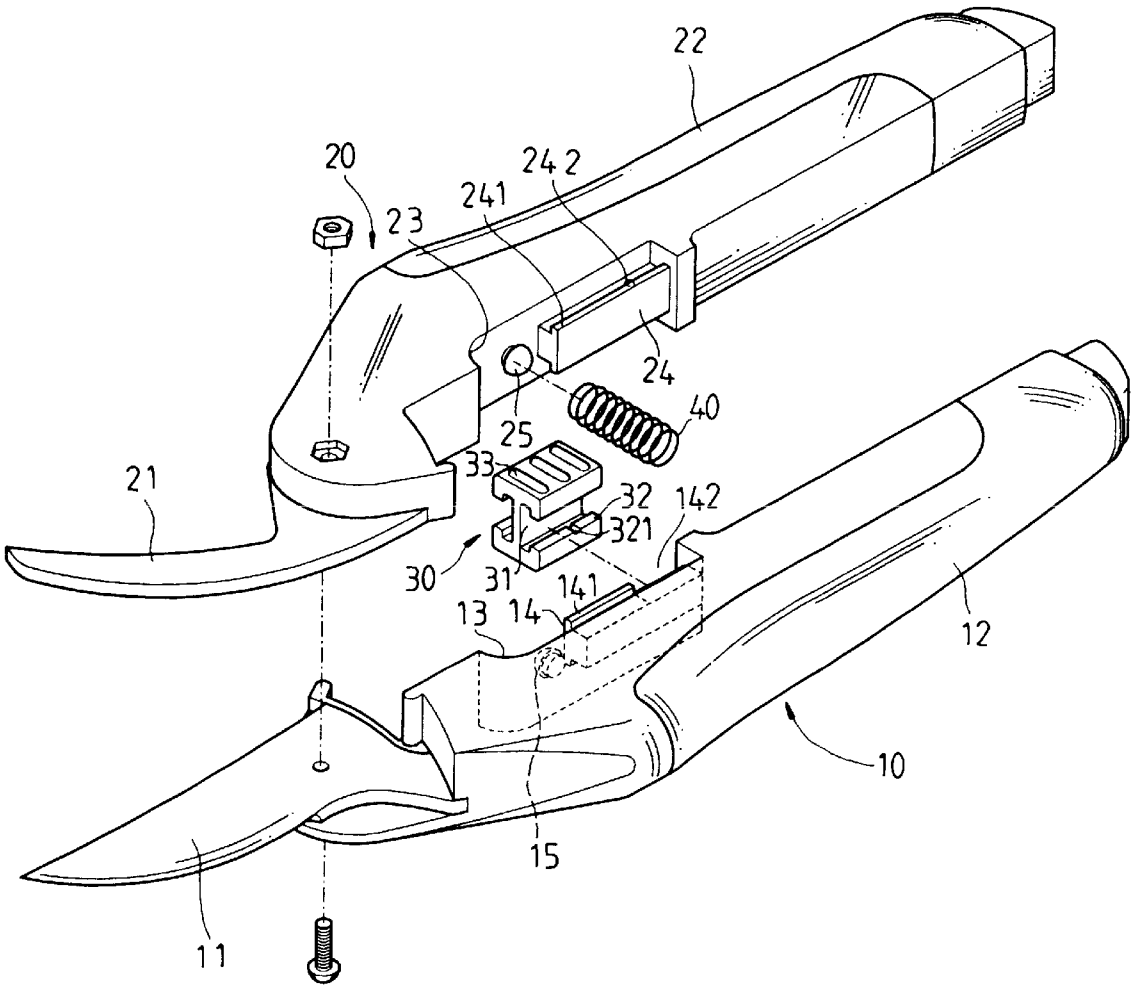
FIG. 2 is an exploded view of the scissors structure as shown in FIG. 1.
Figure 3:
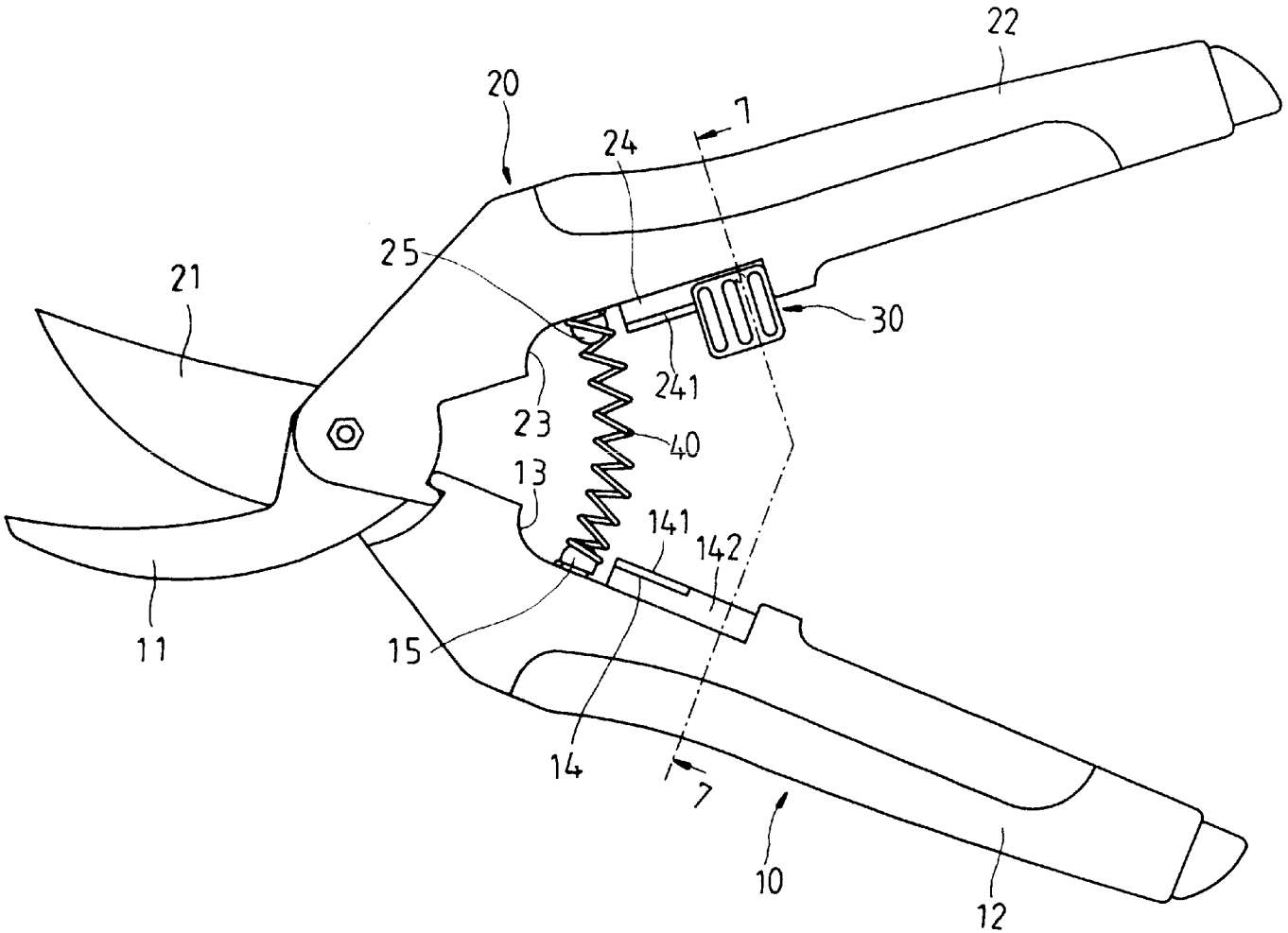
FIG. 3 is a top plan operational view of the scissors structure as shown in FIG. 1.

Referring to the drawings and initially to FIGS. 1–3, a scissors structure in accordance with the present invention comprises a first blade portion 10, a second blade portion 20, a restoring spring 40, and a substantially I-shaped locking member 30.

The first blade portion 10 includes a first blade 11, and a first handle 12 mounted on the first blade 11. The first handle 12 defines a first chamber 13 having a front end provided with a first locking stub 15 and a rear end provided with a T-shaped first guide rail 14. The first guide rail 14 has a front end provided with a first guide track 141 located adjacent to the first locking stub 15 and a rear end defining an access opening 142.

The second blade portion 20 is pivotally mounted on the first blade portion 10 and includes a second blade 21, and a second handle 22 mounted on the second blade 21. The second handle 22 defines a second chamber 23 having a front end provided with a second locking stub 25 and a rear end provided with a T-shaped second guide rail 24 provided with a second guide track 241. At least one snapping boss 242 is mounted on the second guide rail 24 and aligns with the access opening 142 of the first guide rail 14.

The restoring spring 40 is mounted between the first handle 12 and the second handle 22 and has a first end secured to the first locking stub 15 and a second secured to the second locking stub 25.

The locking member 30 is slidably mounted between the first guide rail 14 and the second guide rail 24 and has two sides each provided with a T-shaped guide slot 31 for receiving the first guide track 141 of the first guide rail 14 and the second guide track 241 of the second guide rail 24. The guide slot 31 has two sides each provided with an inward folded retaining flange 32 for limiting the first guide track 141 of the first guide rail 14 and the second guide track 241 of the second guide rail 24. The retaining flange 32 defines at least one positioning notch 321 for detachably locking the snapping boss 242 therein.

The locking member 30 is provided with a plurality of a plurality of elongated ribs 33 protruding outward for increasing friction of the locking member 30.

Alternatively, the positioning notch 321 defined in the retaining flange 32 and the snapping boss 242 formed on the second guide rail 24 can be interchangeably mounted. In other words, the positioning notch is defined in the second guide rail 24, and the snapping boss 242 is formed on the retaining flange 32.

Figure 7:
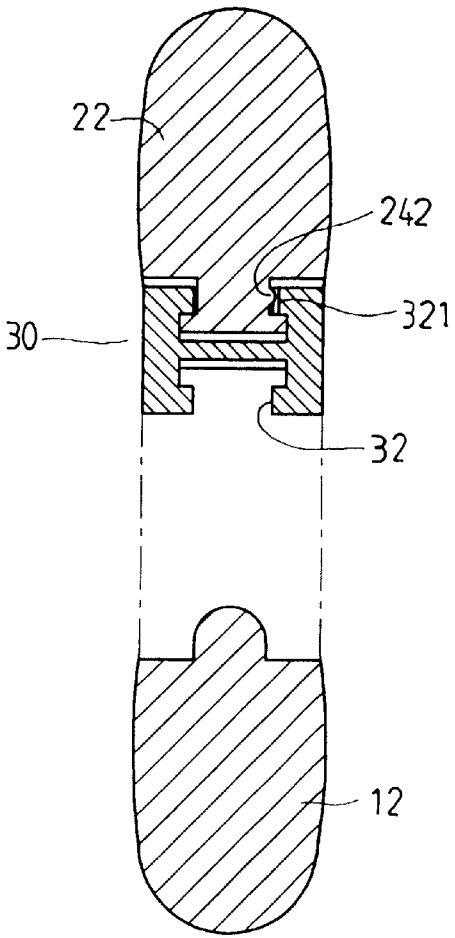
FIG. 7 is a side plan cross-sectional view of the scissors structure along the line 7—7 as shown in FIG. 3.

In operation, referring to FIGS. 1–7, the snapping boss 242 is initially locked in the positioning notch 321 so that the locking member 30 is stably secured on the second guide rail 24 of the second handle 22 as shown in FIGS. 3 and 7. In such a manner, the first handle 12 and the second handle 22 are pressed outward relative to each other by means of the restoring spring 40, thereby expanding the scissors structure for use.

Figure 4:
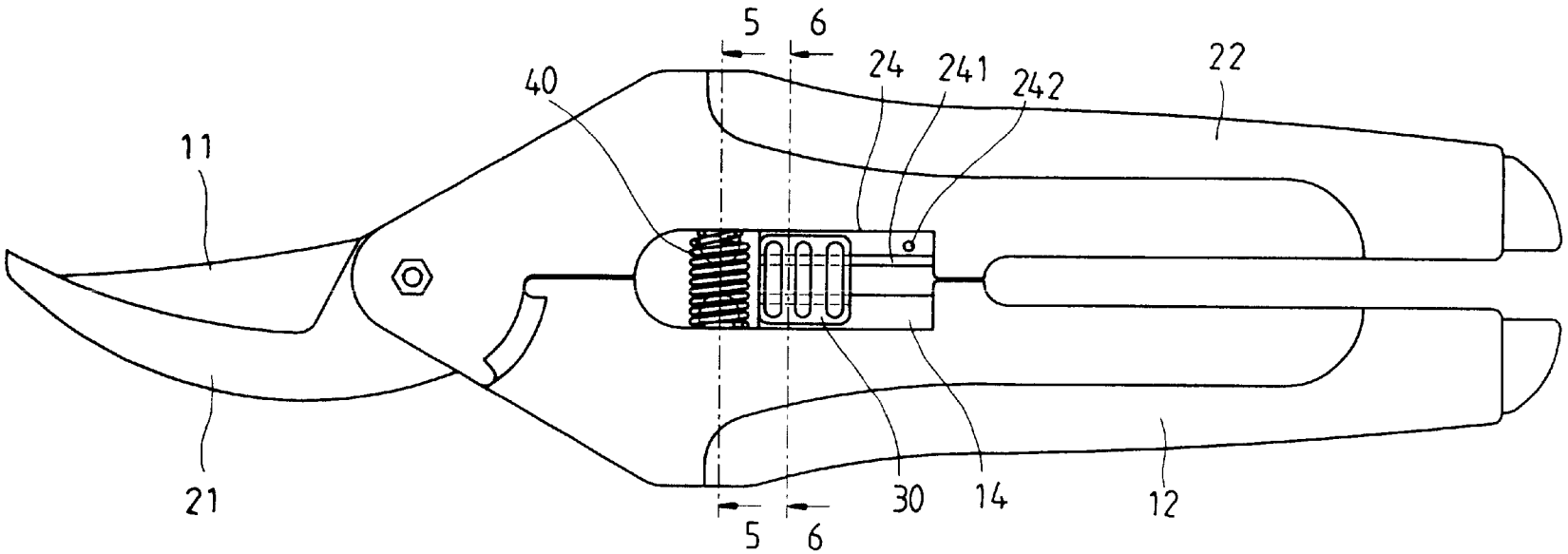
FIG. 4 is a top plan view of the scissors structure as shown in FIG. 1.
Figure 6:
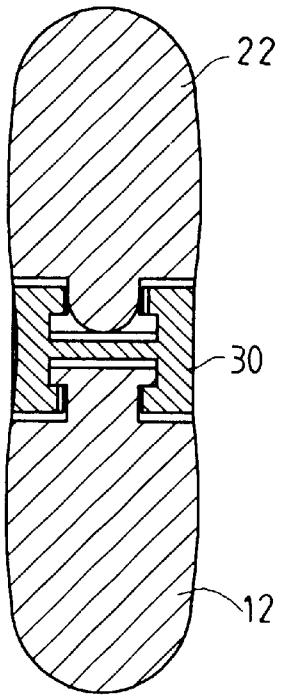
FIG. 6 is a side plan cross-sectional view of the scissors structure along the line 6—6 as shown in FIG. 4.
Figure 5:
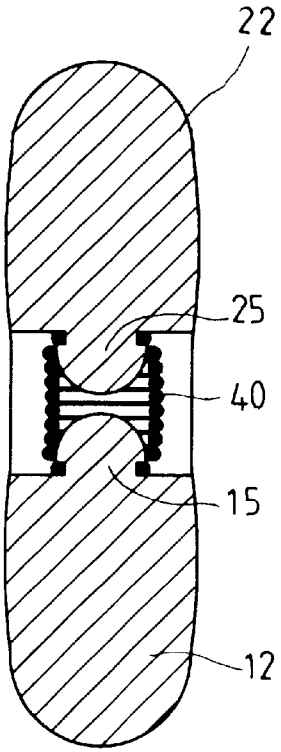
FIG. 5 is a side plan cross-sectional view of the scissors structure along the line 5—5 as shown in FIG. 4.
Figure 8:
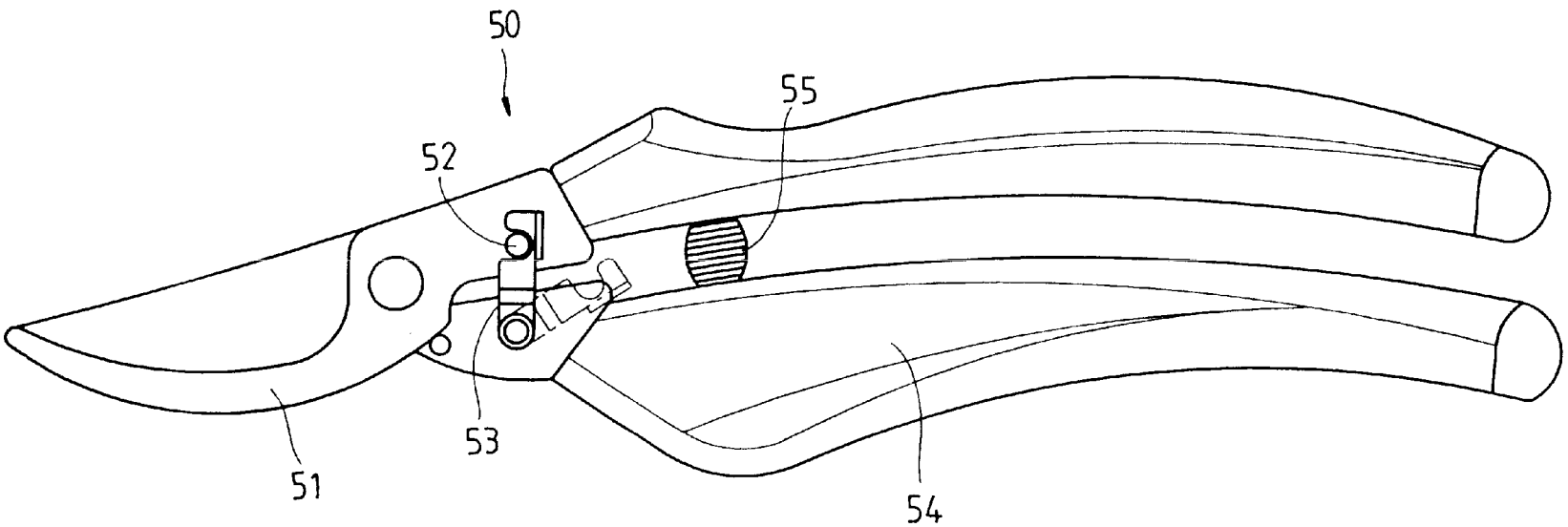
FIG.8 PRIOR ART
FIG. 8 is a perspective view of a conventional scissors structure in accordance with the prior art.

When not in use, the user's hand can exert a force on the first handle 12 and the second handle 22 which are moved toward each other so as to move the locking member 30 toward the first guide rail 14 until the retaining flange 32 of the guide slot 31 of the locking member 30 is inserted into the access opening 142 of the first guide rail 14. The locking member 30 is then moved toward the restoring spring 40 to the position as shown in FIG. 4 where the first guide track 141 of the first guide rail 14 is received in the guide slot 31 of the locking member 30 and is limited by the retaining flange 32 of the guide slot 31 of the locking member 30 so that the first handle 12 and the second handle 22 are secured by the locking member 30 as shown in FIG. 6 while the restoring spring 40 is compressed between the first handle 12 and the second handle 22, thereby folding the scissors structure.

Accordingly, the scissors structure of the present invention has the following advantages.

1. The locking member 30 can be used to lock the scissors structure when it is folded.

2. When the first handle 12 and the second handle 22 are separated from each other, the snapping boss 242 is locked in the positioning notch 321 so that the locking member 30 is secured on and cannot be detached from the second guide rail 24 of the second handle 22, thereby preventing the locking member 30 from freely sliding forward on the guide track 241 to hinder the relative movement between the first handle 12 and the second handle 22 and to hinder the cutting operation of the scissors structure, and thereby preventing the locking member 30 being hit or broken when the first handle 12 and the second handle 22 are moved toward each other so as to increase the lifetime of the scissors structure.

3. The restoring spring 40 is mounted on the front end of each the two handles 12 and 22, thereby preventing the user's hand being clipped or injured by the restoring spring 40.

4. The restoring spring 40 is mounted on the front end of each the two handles 12 and 22, thereby increasing the tension of the two handles 12 and 22 of the scissors structure.

It should be clear to those skilled in the art that further embodiments may be made without departing from the scope of the present invention.

What is claimed is:

1. A scissors structure comprising:

a first blade portion (10) including a first handle (12) defining a first chamber (13) having a front end provided with a first locking stub (15) and a rear end provided with a T-shaped first guide rail (14), said first guide rail (14) having a front end provided with a first guide track (141) located adjacent to said first locking stub (15) and a rear end defining an access opening (142);

a second blade portion (20) pivotally mounted on said first blade portion (10) and including a second handle (22) defining a second chamber (23) having a front end provided with a second locking stub (25) and a rear end provided with a T-shaped second guide rail (24) provided with a second guide track (241), at least one snapping boss (242) mounted on said second guide rail (24) and aligning with said access opening (142) of said first guide rail (14);

a restoring spring (40) mounted between said first handle (12) and said second handle (22) and having a first end secured to said first locking stub (15) and a second secured to said second locking stub (25); and a substantially I-shaped locking member (30) slidably mounted between said first guide rail (14) and said second guide rail (24) and having two sides each provided with a T-shaped guide slot (31) for receiving said first guide track (141) of said first guide rail (14) and said second guide track (241) of said second guide rail (24), said guide slot (31) having two sides each provided with an inward folded retaining flange (32) for limiting said first guide track (141) of said first guide rail (14) and said second guide track (241) of said second guide rail (24), said retaining flange (32) defining at least one positioning notch (321) for detachably locking said at least one snapping boss (242).

2. The scissors structure in accordance with claim 1, wherein said positioning notch (321) and said snapping boss (242) are interchangeably mounted.

3. The scissors structure in accordance with claim 1, wherein said locking member (30) is provided with a plurality of a plurality of elongated ribs (33) protruding outward for increasing friction of said locking member (30).

* * * * *